US008104872B2

(12) United States Patent
Kwon et al.

(10) Patent No.: US 8,104,872 B2
(45) Date of Patent: Jan. 31, 2012

(54) INKJET PRINTHEAD AND METHOD OF MANUFACTURING THE SAME

(75) Inventors: Myong-Jong Kwon, Suwon-si (KR); Sung-Joon Park, Suwon-si (KR); Jin-Wook Lee, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 443 days.

(21) Appl. No.: 12/468,884

(22) Filed: May 20, 2009

(65) Prior Publication Data

US 2010/0060695 A1 Mar. 11, 2010

(30) Foreign Application Priority Data

Sep. 8, 2008 (KR) ..... 10-2008-0088476

(51) Int. Cl.
*B41J 2/14* (2006.01)
*B41J 2/16* (2006.01)

(52) U.S. Cl. ..... 347/47; 347/45; 347/64

(58) Field of Classification Search ..... 347/15, 347/40, 43–47, 65–71, 73, 77, 82
See application file for complete search history.

(56) References Cited

U.S. PATENT DOCUMENTS 5,436,650 A * 7/1995 Kobayashi et al. ..... 347/63
7,232,206 B2 * 6/2007 Sasaki et al. ..... 347/45
2009/0252923 A1 * 10/2009 Ciampini et al. ..... 428/137

* cited by examiner

*Primary Examiner* — Thinh Nguyen
(74) *Attorney, Agent, or Firm* — Staas & Halsey LLP

(57) ABSTRACT

An inkjet printhead includes: a substrate in which an ink feed hole is formed; a chamber layer which is formed on the substrate by performing a photolithography process and which includes a first photosensitive resin; and a nozzle layer which is formed on the chamber layer by performing a photolithography process and which includes a second photosensitive resin. The first photosensitive resin and the second photosensitive resin are materials which are developed by different developing solutions, respectively. Additional layers and components may be incorporated into the inkjet printhead and may be formed on an upper surface of the substrate. The additional layers and components may include an insulating layer, one or more heaters, one or more electrodes, a passivation layer, a glue layer, and an anti-cavitation layer.

23 Claims, 9 Drawing Sheets

INKJET PRINTHEAD AND METHOD OF MANUFACTURING THE SAME

CROSS-REFERENCE TO RELATED PATENT APPLICATION

This application claims the benefit of Korean Patent Application No. 10-2008-0088476, filed on Sep. 8, 2008, in the Korean Intellectual Property Office, the disclosure of which is incorporated herein in its entirety by reference.

TECHNICAL FIELD

The present disclosure relates to a thermal inkjet printhead and a method of manufacturing the same.

BACKGROUND OF RELATED ART

An inkjet printhead is a device for printing a predetermined color image by ejecting minute droplets of ink on a desired area of a printing paper. Inkjet printheads may be generally classified into two types according to the ejection mechanism of ink droplets. The first type is a thermal inkjet printhead that ejects ink droplets using the expansion force of ink bubbles created using a heat source, and the second type is a piezoelectric inkjet printhead that ejects inkjet droplets using a pressure created by the deformation of a piezoelectric element.

For the ejection mechanism of ink droplets of a thermal inkjet printhead, a pulse type current is applied to a heater composed of a heating resistor, and ink around the heater is instantly heated to approximately 300° C. Thus, the ink boils, and an ink bubble is generated. The expansion of the ink bubble applies pressure to the ink filled in the ink chamber. As a result, ink is ejected from the ink chamber to the outside through nozzle in the form of droplet.

SUMMARY

The present disclosure provides a thermal inkjet printhead and a method of manufacturing the same.

According to an aspect of the present disclosure, an inkjet printhead includes: a substrate in which an ink feed hole is formed; a chamber layer which is formed on the substrate by performing a photolithography process and which includes a first photosensitive resin; and a nozzle layer which is formed on the chamber layer by performing a photolithography process and which includes a second photosensitive resin. The first photosensitive resin and the second photosensitive resin are materials which may be developed by different developing solutions, respectively.

Both the first and second photosensitive resins may include a negative-type photosensitive polymer. In this case, non-exposure portions of the first and second photosensitive resins may be developed by different developing solutions, respectively. The chamber layer may be formed by an exposure portion of the first photosensitive resin, and the nozzle layer may be formed by an exposure portion of the second photosensitive resin, and each of the exposure portions of the first and second photosensitive resin has a cross-linked structure.

The first photosensitive resin may include an alkali soluble resin, and the second photosensitive resin may include a solvent-soluble resin. On the other hand, the first photosensitive resin may include a solvent-soluble resin, and the second photosensitive resin may include an alkali soluble resin.

The inkjet printhead may further include a plurality of ink chambers formed in the chamber layer and filled with ink supplied from the ink feed hole and a plurality of nozzles formed in the nozzle layer for ejecting ink.

The inkjet printhead may further include an insulating layer formed on the substrate; a plurality of heaters and electrodes sequentially formed on the insulating layer; and a passivation layer formed to cover the heaters and the electrodes. The inkjet printhead may further include an anti-cavitation layer formed on the passivation layer and a glue layer formed on the passivation layer.

According to another aspect of the present disclosure, a method of manufacturing an inkjet printhead includes: forming an ink feed hole in a substrate; forming a chamber material layer including a first photosensitive resin on the substrate; performing an exposure process and a post exposure bake (PEB) process on the chamber material layer, thereby forming an exposure portion and a non-exposure portion of the chamber material layer; forming a nozzle material layer including a second photosensitive resin on the chamber material layer; performing an exposure process on the nozzle material layer, thereby forming an exposure portion and a non-exposure portion of the nozzle material layer; forming a chamber layer having a plurality of ink chambers by performing a developing process on the chamber material layer; and forming a nozzle layer having a plurality of nozzles by performing the PEB process and the developing process on the nozzle material layer.

Each of the first and second photosensitive resins may include a negative-type photosensitive polymer. The first photosensitive resin included in the non-exposure portion of the chamber material layer and the second photosensitive resin included in the non-exposure portion of the nozzle material layer may be developed by different developing solutions, respectively.

Each of the chamber material layer and the nozzle material layer may be formed of a dry film.

Forming the chamber layer may include, after the PEB process is performed on the chamber material layer, removing the non-exposure portion of the chamber material layer with a predetermined developing solution. Forming the nozzle material layer may include, after the PEB process is performed on the nozzle material layer, removing the non-exposure portion of the nozzle material layer with a predetermined developing solution.

The first photosensitive resin included in the exposure portion of the chamber material layer may have a cross-linked structure through the PEB process, and the second photosensitive resin included in the exposure portion of the nozzle material layer may have a cross-linked structure through the PEB process.

The ink feed hole may be formed to penetrate the substrate from an upper surface of the substrate to a lower surface of the substrate.

BRIEF DESCRIPTION OF THE DRAWINGS

Various features and advantages of the disclosure will become more apparent by the following detailed description of several embodiments thereof with reference to the attached drawings, of which.

DETAILED DESCRIPTION OF THE INVENTION

Figure 1:
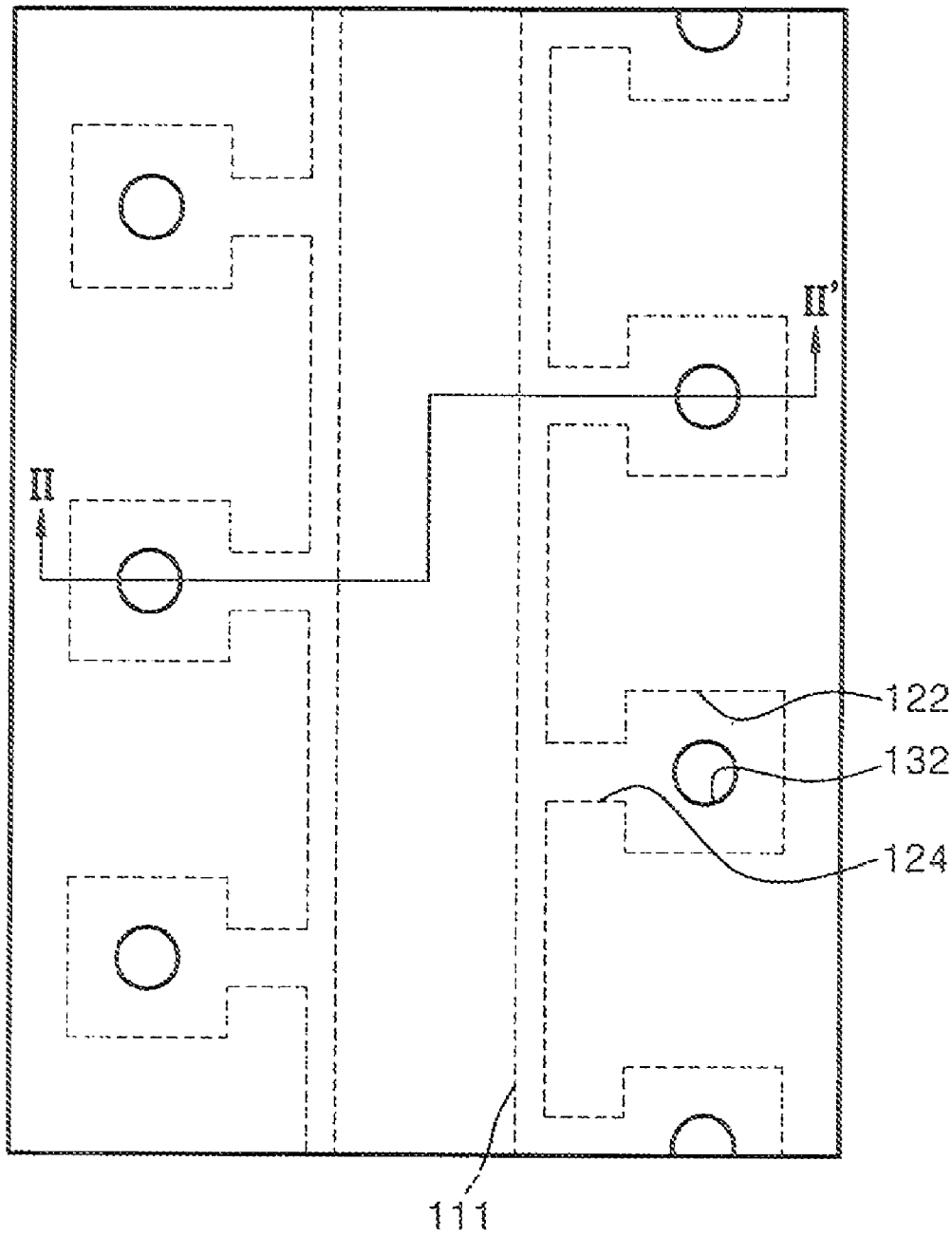
FIG. 1 is a schematic plan view of an inkjet printhead according to an embodiment.

Reference will now be made in detail to embodiments of the present invention, examples of which are illustrated in the accompanying drawings, wherein like reference numerals refer to like elements. While the embodiments are described with detailed construction and elements to assist in a comprehensive understanding of the various applications and advantages of the embodiments, it should be apparent however that the embodiments can be carried out without those specifically detailed particulars. Also, well-known functions or constructions will not be described in detail so as to avoid obscuring the description with unnecessary detail. It should be also noted that in the drawings, the dimensions of the features are not intended to be to true scale and may be exaggerated for the sake of allowing greater understanding.

Figure 2:
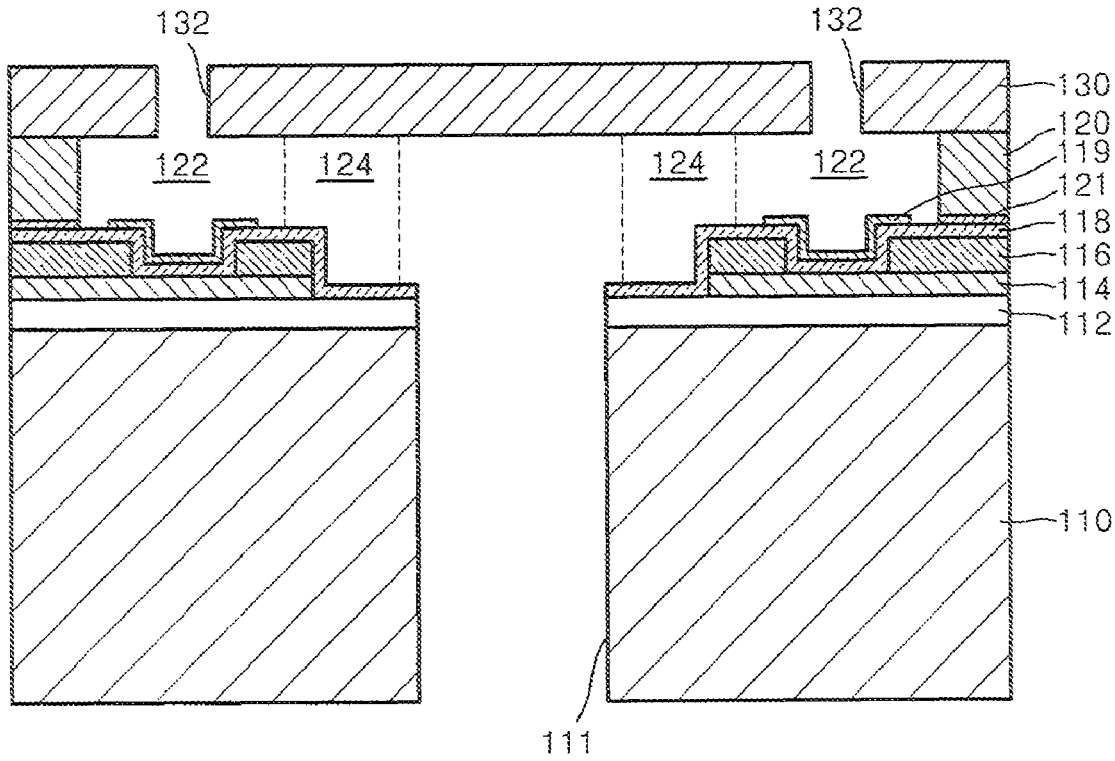
FIG. 2 is a cross-sectional view taken along a line II-II' of FIG. 1, according to an embodiment.

FIG. 1 is a schematic plan view of an inkjet printhead according to an embodiment. FIG. 2 is a cross-sectional view taken along a line II-II' of FIG. 1.

Referring to FIGS. 1 and 2, the inkjet printhead according to an embodiment may include a chamber layer 120 and a nozzle layer 130 sequentially formed on a substrate 110 on which a plurality of material layers may be formed. The substrate 110 may be formed of, for example, silicon. An ink feed hole 111 for supplying ink may be formed through the substrate 110.

An insulating layer 112 for insulating the substrate 110 from a plurality of heaters 114 may be formed on an upper surface of the substrate 110. The insulating layer 112 may be formed of, for example, silicon oxide. The heaters 114, for generating bubbles by heating the ink in ink chambers 122, may be formed on an upper surface of the insulating layer 112. The heaters 114 may be formed on bottom surfaces of the ink chambers 122. The heaters 114 may be formed of a heat resistant material, such as a tantalum-aluminum alloy, tantalum nitride, titanium nitride, tungsten silicide, or the like. A plurality of electrodes 116 may be formed on upper surfaces of the heaters 114. The electrodes 116 apply current to the heaters 114 and may be formed of a material with excellent electrical conductivity. In this regard, the electrodes 116 may be formed of, for example, aluminum (Al), an aluminum alloy, gold (Au), silver (Ag), or the like.

A passivation layer 118 may be formed on the upper surfaces of the heaters 114 and the electrodes 116. The passivation layer 118 prevents the heaters 114 and the electrodes 116 from being oxidized or corroded by contact with the ink and may be formed of silicon nitride or silicon oxide, for example. Also, an anti-cavitation layer 119 may be formed on an upper surface of one or more portions of the passivation layer 118 above the heaters 114. The anti-cavitation layer 119 protects the heaters 114 from a cavitation force generated during bubble annihilation and may be formed of tantalum (Ta). A glue layer 121 may be further formed on one or more portions of the passivation layer 118 to sufficiently attach the chamber layer 120 to the passivation layer 118.

The chamber layer 120 including a first photosensitive resin may be formed on the passivation layer 118. A plurality of ink chambers 122 to be filled with ink supplied from the ink feed hole 111 may be formed in the chamber layer 120. Also, a plurality of restrictors 124 may be formed in the chamber layer 120 to provide the ink paths between the ink feed hole 111 and the ink chambers 122. The chamber layer 120 may be formed by forming a chamber material layer 120' (see FIG. 5) including the first photosensitive resin on the passivation layer 118 and patterning the chamber material layer 120' through a photolithography process, for example. The first photosensitive resin may include a negative-type photosensitive polymer, for example. In this case, a non-exposure portion of the first photosensitive resin may be removed by a predetermined developing solution to form the ink chambers 122 and restrictors 124. An exposure portion of the first photosensitive resin may have a cross-linked structure as a result of a post exposure bake (PEB) process to form the chamber layer 120.

The nozzle layer 130 including a second photosensitive resin is formed on the chamber layer 120. A plurality of nozzles 132 for ejecting ink may be formed in the nozzle layer 130. The nozzle layer 130 may be formed by forming a nozzle material layer 130' (see FIG. 7) including the second photosensitive resin on the chamber material layer 120 and patterning the nozzle material layer 130' through a photolithography process, for example. The second photosensitive resin may include a negative-type photosensitive polymer. In this case, a non-exposure portion of the second photosensitive resin may be removed by a predetermined developing solution to form the nozzles 132. An exposure portion of the second photosensitive resin may have a cross-linked structure through a PEB process to form the nozzle layer 130.

In an embodiment, the first photosensitive resin, which is included in the chamber layer 120, and the second photosensitive resin, which is included in the nozzle layer 130, may be removed by different developing solutions, respectively. In particular, when both the first and second photosensitive resins are negative-type photosensitive polymers, the non-exposure portion of the first photosensitive resin and the non-exposure portion of the second photosensitive resin may be developed by different developing solutions, respectively. Accordingly, the non-exposure portion of the first photosensitive resin may not be removed by the developing solution used to develop the non-exposure portion of the second photosensitive resin, and the non-exposure portion of the second photosensitive resin may not be removed by the developing solution used to develop the non-exposure portion of the first photosensitive resin.

The first photosensitive resin may be an alkali soluble resin, and the second photosensitive resin may be a solvent-soluble resin, for example. The alkali soluble resin may be, for example, ANR manufactured by AZ Co. Ltd., SPS manufactured by Shinetsu Chemical Co. Ltd., WPR manufactured by JSP Co. Ltd., or the like, and the solvent-soluble resin may be Su-8 manufactured by Micro Chem., Inc., or the like, but neither resin is limited thereto. In the alternative, the first photosensitive resin may be a solvent-soluble resin, while the second photosensitive resin may be an alkali soluble resin. However, the aforementioned materials are just, and various other materials may be used.

FIGS. 3 through 10 provide cross-sectional views to aid in the explanation of a method of manufacturing an inkjet printhead, according to an embodiment.

Figure 3:
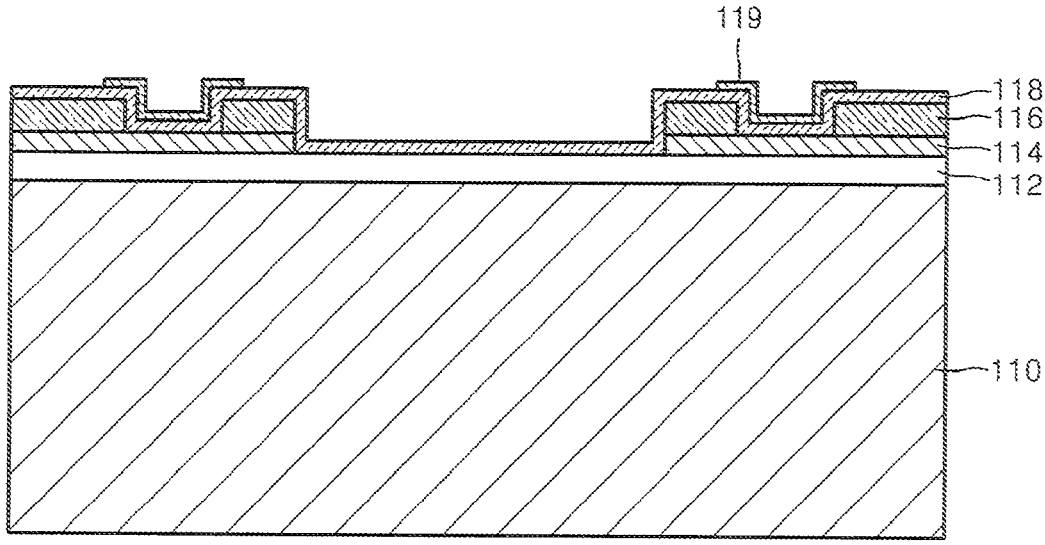
FIGS. 3 through 10 are cross-sectional views illustrating a method of manufacturing an inkjet printhead, according to an embodiment.

Referring to FIG. 3, first, a substrate 110 is prepared. Then, an insulating layer 112 is formed on an upper surface of the substrate 110. The substrate 110 may be a silicon substrate, for example. The insulating layer 112 insulates the substrate 110 from a plurality of heaters 114 and may be formed of, for example, silicon oxide. Next, the heaters 114 for creating bubbles by heating ink are formed on an upper surface of the insulating layer 112. The heaters 114 may be formed by depositing and patterning a heat-resistant material, such as a tantalum-aluminum alloy, tantalum-nitride, titanium-nitride, or tungsten-silicide, on the insulating layer 112. Then, a plurality of electrodes 116 for applying current to the heaters 114 are formed on an upper surface of the heaters 114. The electrodes 116 may be formed by depositing and patterning a material having excellent electrical conductivity, for example, Al, an Al alloy, Au, or Ag, on the heaters 114.

A passivation layer 118 may be formed on the insulating layer 112 to cover the heaters 114 and the electrodes 116. The passivation layer 118 prevents the heaters 114 and the electrodes 116 from being oxidized or corroded by contact with ink and may be formed of, for example, silicon nitride or silicon oxide. An anti-cavitation layer 119 may further be formed on an upper surface of one or more portions of the passivation layer 118 above the heaters 114. The anti-cavitation layer 119 protects the heaters 114 from a cavitation force generated during bubble annihilation and may be formed of tantalum (Ta), for example.

Figure 4:
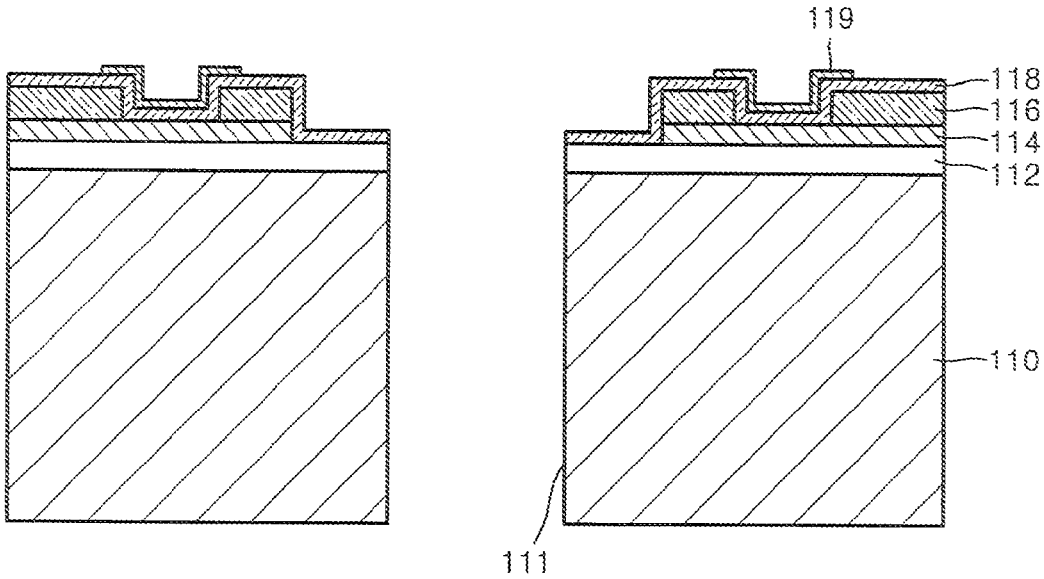

Referring to FIG. 4, an ink feed hole 111 for supplying ink may be formed through the substrate 110 and one or more layers. The ink feed hole 111 may be formed by sequentially processing the passivation layer 118, the insulating layer 112, and the substrate 110. The ink feed hole 111 may be formed by dry etching, wet etching, laser processing, or the like. In the current embodiment, the ink feed hole 111 may be formed to penetrate the substrate 110 from the upper surface of the substrate 110 to the lower surface of the substrate 110. As such, when the ink feed hole 111 is formed by processing the upper surface of the substrate 110, the upper portion of the ink fee hole 111 may be accurately formed in a desired position of the substrate 110. Thus, ink may uniformly flow from the ink feed hole 111 into each of a plurality of ink chambers 122.

Figure 5:
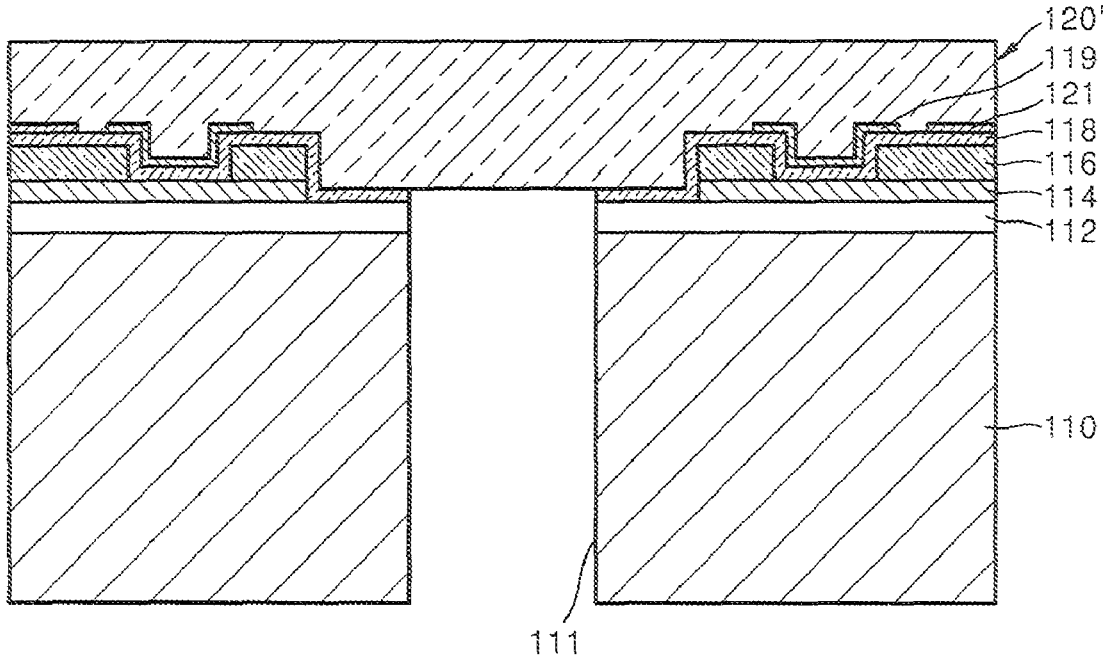

Referring to FIG. 5, a chamber material layer 120' may be formed on the passivation layer 118. The chamber material layer 120' may include a first photosensitive resin, such as a photo acid generator (PAG), for example. The chamber material layer 120' may be formed by laminating a dry film including the first photosensitive resin, such as the PAG, on the passivation layer 118. The first photosensitive resin may be a negative-type photosensitive polymer. The first photosensitive resin may be, for example, an alkali soluble resin. A glue layer 121 may further be formed on the passivation layer 118 in order to improve adhesion between the chamber material layer 120' and the passivation layer 118.

Figure 6:
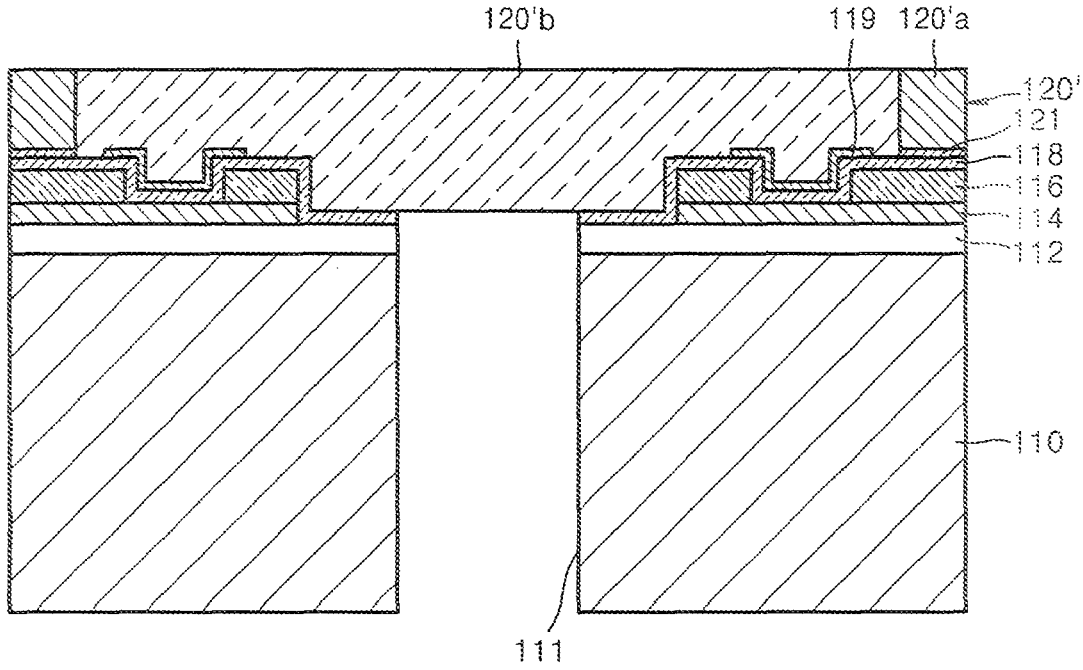

Referring to FIG. 6, an exposure process and a post exposure bake (PEB) process may be performed on the chamber material layer 120'. The exposure process is performed on the chamber material layer 120' by using a photomask (not shown) including an ink chamber pattern and a restrictor pattern, for example. When the first photosensitive resin is a negative-type photosensitive polymer, acid is generated from an exposure portion 120'*a* of the chamber material layer 120' by the PAG during the exposure process. Next, the PEB process is performed on the chamber material layer 120'. The PEB process may be performed in a temperature range of about 90 to 120° C. for about 3 to 5 minutes, although other temperature ranges and time durations may be utilized during the PEB process. The first photosensitive resin in the exposure portion 120'*a* of the chamber material layer 120' is cross-linked as a result of the PEB process. In FIG. 6, reference numeral 120'*b* denotes a non-exposure portion of the chamber material layer 120'.

Figure 7:
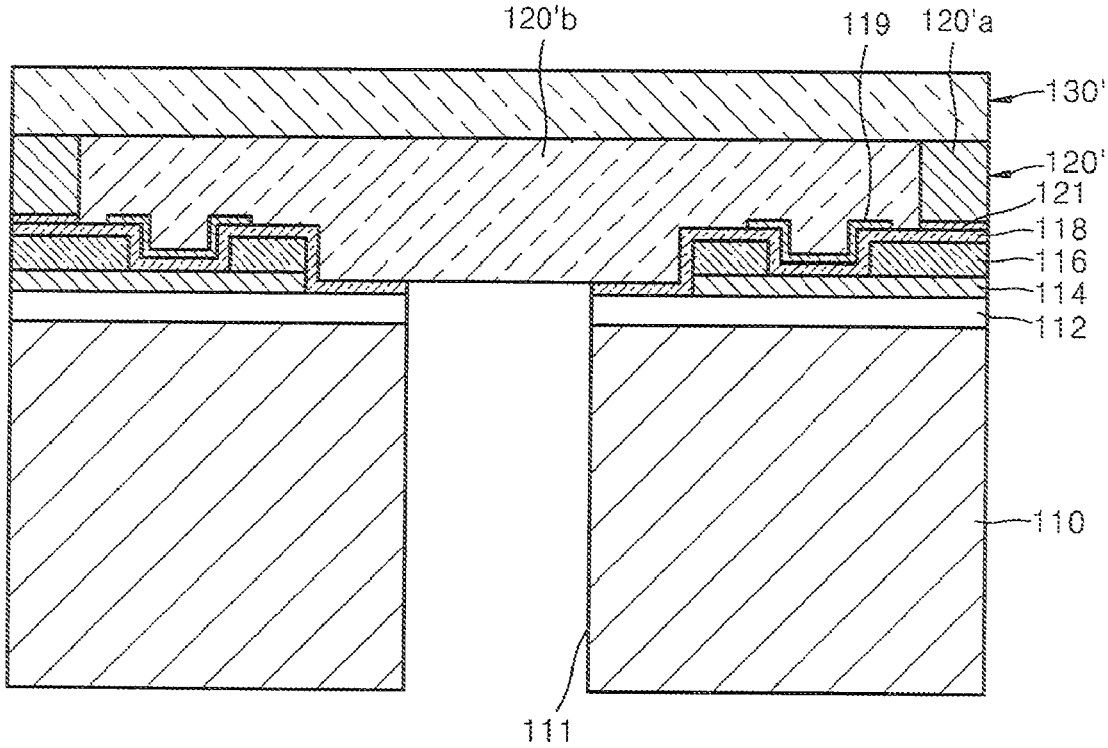

Referring to FIG. 7, a nozzle material layer 130' is formed on the chamber material layer 120' on which the exposure process and the PEB process are performed. The nozzle material layer 130' may include a second photosensitive resin, such as a PAG. The nozzle material layer 130' may be formed by laminating a dry film including the second photosensitive resin, e.g., PAG, on the chamber material layer 120'. The second photosensitive resin may be a negative-type photosensitive polymer. In an embodiment, the second photosensitive resin is developed by a developing solution which is different from that used to develop the aforementioned first photosensitive resin. In particular, when both the first and second photosensitive resins are negative-type photosensitive polymers, the non-exposure portion of the first photosensitive resin and the non-exposure portion of the second photosensitive resin are developed by different developing solutions. The second photosensitive resin may be a solvent-soluble resin.

Figure 8:
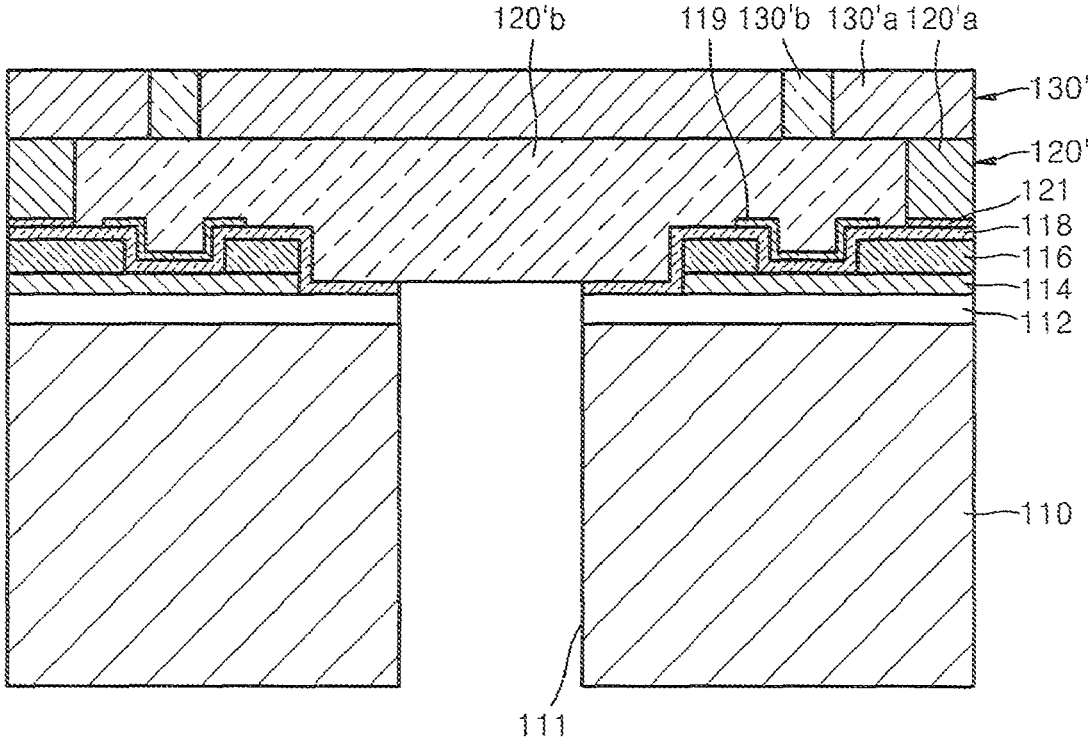

Referring to FIG. 8, an exposure process is performed on the nozzle material layer 130'. The exposure process is performed using a photomask (not shown) in which a nozzle pattern is formed on the nozzle material layer 130'. When the second photosensitive resin is a negative-type photosensitive polymer, acid is generated from an exposure portion 130'*a* of the nozzle material layer 130' by the PAG during the exposure process. In FIG. 8, reference numeral 130'*b* denotes a non-exposure portion of the nozzle material layer 130'.

Figure 9:
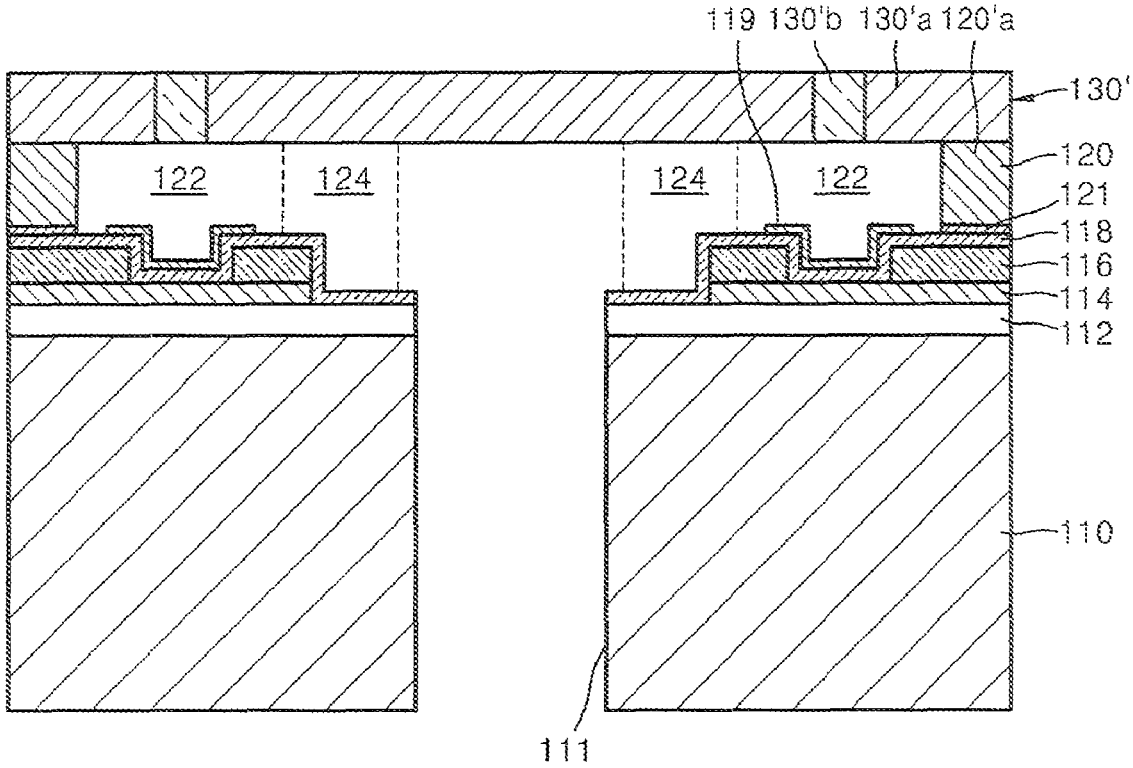

Referring to FIG. 9, a chamber layer 120 is formed by performing a developing process on the chamber material layer 120' on which the exposure process and the PEB process are performed. The non-exposure portion 120'*b* of the chamber material layer 120' is removed by a predetermined developing solution during the developing process to form a plurality of ink chambers 122 and restrictors 124. Since the first photosensitive resin included in the exposure portion 120'*a* of the chamber material layer 120' has a cross-linked structure as a result of the PEB process, the exposure portion 120'*a* of the chamber material layer 120' is not removed by the developing process, thereby forming the chamber layer 120. When the first photosensitive resin included in the chamber material layer 120' is an alkali soluble resin, the developing solution used to develop the non-exposure portion 120'*b* of the chamber material layer 120' may be, for example, 300MIF, 400K, CD30, or the like manufactured by AZ Co., Ltd., but other developing solutions or methods may be employed.

As described above, the first photosensitive resin included in the chamber material layer 120' uses a developing solution which is different from that used to develop the second photosensitive resin included in the nozzle material layer 130'. Thus, the nozzle material layer 130' on which the exposure process has been performed is not removed during the developing process of the chamber material layer 120'. In general, when a negative-type photosensitive material layer on which both a non-exposure process and a PEB process have been performed is developed, only the exposure portion of the material layer may be removed by a developing solution. Therefore, if a material layer on which the exposure process is performed but the PEB process is not performed is developed, both the exposure portion arid the non-exposure portion of the material layer may typically be removed by the developing solution. Accordingly, if the first photosensitive resin of the chamber material layer 120' and the second photosensitive resin included in the nozzle material layer 130' are materials developed by the same developing solution, the nozzle material layer 130' may be developed and removed simultaneously when the chamber material layer 120' is developed. In an embodiment, in order to overcome this problem, the second photosensitive resin is formed of a material which is not removed by the developing solution used to develop the first photosensitive resin. Thus, the nozzle material layer 130' on which the exposure process has been performed is not removed during the developing process of the chamber material layer 120'.

Figure 10:
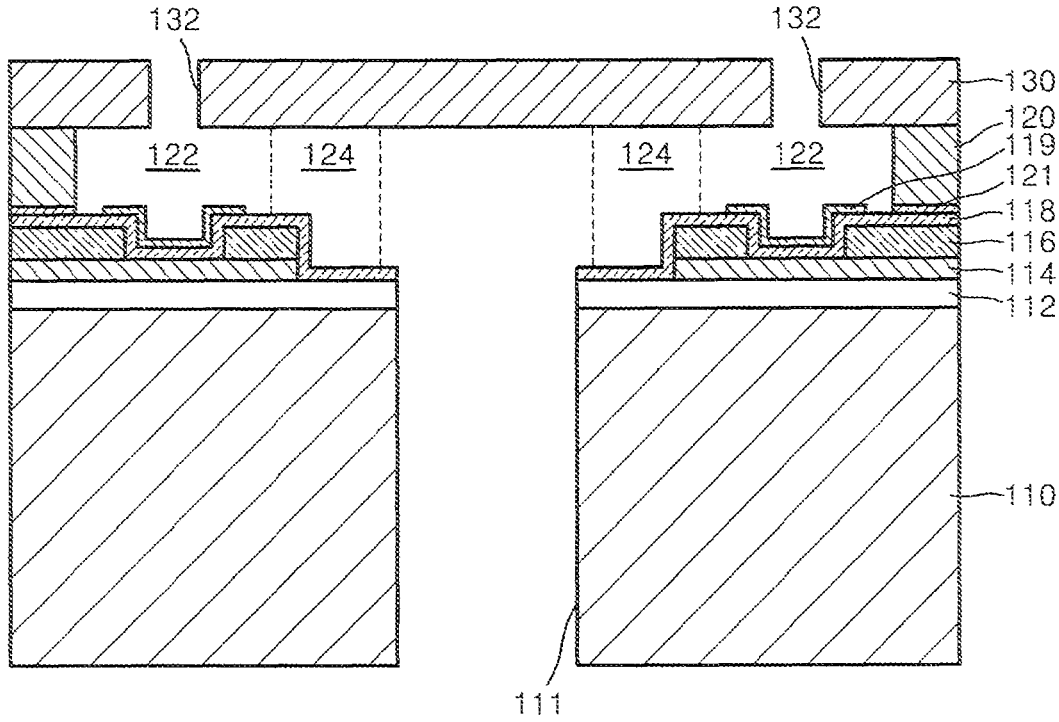

Referring to FIG. 10, a nozzle layer 130 is formed by performing a PEB process and a developing process on the nozzle material layer 130' on which the exposure process has been performed. The PEB process is performed on the nozzle material layer 130'. The PEB process may be performed in a temperature range of about 90 to 120° C. for about 3 to 5 minutes, although other temperature ranges and time durations may be utilized during the PEB process. The second photosensitive resin in the exposure portion 130'*a* of the nozzle material layer 130' is cross-linked as a result of the PEB process. Next, the nozzle material layer 130', on which the PEB process has been performed, is developed. Thus, the non-exposure portion 130'*b* of the nozzle material layer 130' is removed by a predetermined developing solution during the developing process to form a plurality of nozzles 132. Since the second photosensitive resin included in the exposure portion 130'*a* of the nozzle material layer 130' has a cross-linked structure through the PEB process, the exposure portion 130'*a* of the nozzle material layer 130' is not removed by the developing process, thereby forming the nozzle layer 130. When the first photosensitive resin included in the nozzle material layer 130' is a solvent-soluble resin, the developing solution used to develop the non-exposure portion 130'*b* of the nozzle material layer 130' may be, but is not limited to, for example, propylene glycol monomethyl ether acetate (PGMEA), gamma-butyrolactone (GBL), cyclopentanon (CP), methyl isobutyl ketone (MIBK), or the like.

In the above embodiments, the first photosensitive resin has been described as being an alkali soluble resin and the second photosensitive resin has been described as being a solvent-soluble resin. Alternatively, however, the first photosensitive resin may be a solvent-soluble resin and the second photosensitive resin may be an alkali soluble resin. Moreover, the embodiments are not limited to these materials, and the first and second photosensitive resins may be formed of various other materials.

According to embodiments, a thermal inkjet printhead may be manufactured by performing a simple process as described above. In the thermal inkjet printhead manufactured using this process, ink uniformly flows into ink chambers by accurately forming an upper portion of an ink feed hole in a desired position.

While the disclosure has been particularly shown and described with reference to several embodiments thereof with particular details, it will be apparent to one of ordinary skill in the art that various changes may be made to these embodiments without departing from the principles and spirit of the invention, the scope of which is defined in the following claims and their equivalents.

What is claimed is:

1. An inkjet printhead comprising:

a substrate;

an ink feed hole formed within the substrate;

a chamber layer formed on the substrate by performing a photolithography process, the chamber layer comprising a first photosensitive resin; and a nozzle layer formed on the chamber layer by performing a photolithography process, the nozzle layer comprising a second photosensitive resin, wherein the first photosensitive resin and the second photosensitive resin comprise materials developed by different developing solutions, respectively.

2. The inkjet printhead of claim 1, wherein both the first and second photosensitive resins comprise a negative-type photosensitive polymer.

3. The inkjet printhead of claim 2, wherein each of the first and second photosensitive resins comprise exposure portions and non-exposure portions, wherein the non-exposure portions are developed by different developing solutions, respectively.

4. The inkjet printhead of claim 3, wherein the chamber layer is formed by the exposure portion of the first photosensitive resin, wherein the nozzle layer is formed by the exposure portion of the second photosensitive resin, and wherein each of the exposure portions of the first and second photosensitive resins comprises a cross-linked structure.

5. The inkjet printhead of claim 1, wherein the first photosensitive resin comprises an alkali soluble resin, and wherein the second photosensitive resin comprises a solvent-soluble resin.

6. The inkjet printhead of claim 1, wherein the first photosensitive resin comprises a solvent-soluble resin, and wherein the second photosensitive resin comprises an alkali soluble resin.

7. The inkjet printhead of claim 1, further comprising a plurality of ink chambers defining spaces to be filled with ink supplied from the ink feed hole and a plurality of nozzles for ejecting ink, wherein the ink chambers are formed in the chamber layer, and wherein the nozzles are formed in the nozzle layer.

8. The inkjet printhead of claim 1, further comprising:

an insulating layer formed on the substrate;

a plurality of heaters and electrodes sequentially formed on the insulating layer; and a passivation layer formed to cover the plurality of heaters and electrodes.

9. The inkjet printhead of claim 8, further comprising an anti-cavitation layer formed on the passivation layer.

10. The inkjet printhead of claim 8, further comprising a glue layer formed on the passivation layer.

11. A method of manufacturing an inkjet printhead, the method comprising:

forming an ink feed hole in a substrate;

forming a chamber material layer comprising a first photosensitive resin on the substrate;

performing an exposure process and a post exposure bake (PEB) process on the chamber material layer to form an exposure portion and a non-exposure portion of the chamber material layer;

forming a nozzle material layer comprising a second photosensitive resin on the chamber material layer;

performing an exposure process on the nozzle material layer to form an exposure portion and a non-exposure portion of the nozzle material layer;

forming a chamber layer having a plurality of ink chambers by performing a developing process on the chamber material layer; and forming a nozzle layer having a plurality of nozzles by performing a PEB process and a developing process on the nozzle material layer.

12. The method of claim 11, wherein each of the first and second photosensitive resins comprises a negative-type photosensitive polymer.

13. The method of claim 12, wherein the first photosensitive resin included in the non-exposure portion of the chamber material layer and the second photosensitive resin included in the non-exposure portion of the nozzle material layer are developed by different developing solutions, respectively.

14. The method of claim 11, wherein the first photosensitive resin comprises an alkali soluble resin, and wherein the second photosensitive resin comprises a solvent-soluble resin.

15. The method of claim 11, wherein the first photosensitive resin comprises a solvent-soluble resin, and wherein the second photosensitive resin comprises an alkali soluble resin.

16. The method of claim 11, wherein each of the chamber material layer and the nozzle material layer is formed of a dry film.

17. The method of claim 11, wherein forming the chamber layer comprises, after the PEB process is performed on the chamber material layer, removing the non-exposure portion of the chamber material layer with a predetermined developing solution.

18. The method of claim 11, wherein forming the nozzle layer comprises, after the PEB process is performed on the nozzle material layer, removing the non-exposure portion of the nozzle material layer with a developing solution.

19. The method of claim 11, wherein the first photosensitive resin included in the exposure portion of the chamber material layer has a cross-linked structure through the PEB process, and wherein the second photosensitive resin included in the exposure portion of the nozzle material layer has a cross-linked structure through the PEB process.

20. The method of claim 11, wherein step of forming the ink feed hole comprises:

removing a portion of the substrate, starting from the removal of an upper surface of the substrate toward a lower surface of the substrate.

21. The method of claim 11, further comprising:

forming an insulating layer on the substrate;

sequentially forming a plurality of heaters and electrodes on the insulating layer; and forming a passivation layer to cover the heaters and the electrodes.

22. The method of claim 21, further comprising:

forming an anti-cavitation layer on the passivation layer.

23. The method of claim 21, further comprising:

forming a glue layer on the passivation layer.

* * * * *